US008364471B2

(12) United States Patent
Yoon et al.

(10) Patent No.: US 8,364,471 B2
(45) Date of Patent: Jan. 29, 2013

(54) APPARATUS AND METHOD FOR PROCESSING A TIME DOMAIN AUDIO SIGNAL WITH A NOISE FILLING FLAG

(75) Inventors: Sung Yong Yoon, Seoul (KR); Hyun Kook Lee, Seoul (KR); Dong Soo Kim, Seoul (KR); Jae Hyun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 463 days.

(21) Appl. No.: 12/612,345

(22) Filed: Nov. 4, 2009

(65) Prior Publication Data

US 2010/0114585 A1 May 6, 2010

Related U.S. Application Data

(60) Provisional application No. 61/111,323, filed on Nov. 4, 2008, provisional application No. 61/114,478, filed on Nov. 14, 2008.

(30) Foreign Application Priority Data

Nov. 3, 2009 (KR) ..... 10-2009-0105389

(51) Int. Cl.
*G10L 19/02* (2006.01)
*G10L 21/02* (2006.01)

(52) U.S. Cl. ..... 704/206; 704/228; 704/230; 704/500

(58) Field of Classification Search ..... 704/205, 704/206, 211, 226, 227, 500, 501, 229, 228, 704/230; 341/67
See application file for complete search history.

(56) References Cited

U.S. PATENT DOCUMENTS 3,716,851 A * 2/1973 Neumann ..... 341/67
5,684,829 A * 11/1997 Kizuki et al. ..... 375/242
5,864,799 A * 1/1999 Corretjer et al. ..... 704/228
6,058,362 A 5/2000 Malvar
6,424,939 B1 7/2002 Herre et al.
6,441,755 B1 * 8/2002 Dietz et al. ..... 341/50
6,529,604 B1 * 3/2003 Park et al. ..... 381/22
6,625,574 B1 * 9/2003 Taniguchi et al. ..... 704/229
6,766,293 B1 7/2004 Herre et al.
7,047,187 B2 5/2006 Cheng et al.
7,181,079 B2 * 2/2007 Herre et al. ..... 382/251

(Continued)

FOREIGN PATENT DOCUMENTS

KR 2003-0014752 A 2/2003
WO WO 97/15916 A1 5/1997

OTHER PUBLICATIONS

Herre et al., "Extending the MPEG-4 AAC Codec by Perceptual Noise Substitution", Preprints of Papers Presented at the AES Convention, Jan. 1, 1998, pp. 1-14, XP008006769.

(Continued)

*Primary Examiner* — Martin Lerner
(74) *Attorney, Agent, or Firm* — Birch, Stewart, Kolasch & Birch, LLP

(57) ABSTRACT

An apparatus and method for processing an audio signal including extracting noise filling flag information indicating whether noise filling is used to a plurality of frames; extracting coding scheme information indicating whether a current frame included in the plurality of frames is coded in either a frequency domain or a time domain; when the noise filling flag information indicates that the noise filling is used for the plurality of frames and the coding scheme information indicates that the current frame is coded in the frequency domain, extracting noise level information for the current frame; when a noise level value corresponding to the noise level information meets a predetermined level, extracting noise offset information for the current frame; and, when the noise offset information is extracted, performs the noise-filling for the current frame based on the noise level value and the noise offset information.

13 Claims, 15 Drawing Sheets

U.S. PATENT DOCUMENTS

| | | | | |
|---|---|---|---|---|
| 7,318,027 | B2 * | 1/2008 | Lennon et al. | 704/500 |
| 7,483,836 | B2 * | 1/2009 | Taori et al. | 704/500 |
| 7,756,702 | B2 * | 7/2010 | Pang et al. | 704/206 |
| 2003/0009325 | A1 | 1/2003 | Kirchherr et al. | |
| 2003/0125910 | A1 * | 7/2003 | Randmaa et al. | 702/191 |
| 2003/0233234 | A1 | 12/2003 | Truman et al. | |
| 2005/0010396 | A1 * | 1/2005 | Chiu et al. | 704/200.1 |
| 2005/0228658 | A1 * | 10/2005 | Yang et al. | 704/225 |
| 2006/0089832 | A1 | 4/2006 | Ojanpera | |
| 2006/0271356 | A1 * | 11/2006 | Vos | 704/222 |
| 2007/0027677 | A1 * | 2/2007 | Ouyang et al. | 704/200.1 |
| 2010/0023336 | A1 * | 1/2010 | Shmunk | 704/503 |
| 2010/0114585 | A1 * | 5/2010 | Yoon et al. | 704/500 |
| 2011/0015768 | A1 * | 1/2011 | Lim et al. | 700/94 |
| 2011/0170711 | A1 * | 7/2011 | Rettelbach et al. | 381/98 |
| 2011/0320196 | A1 * | 12/2011 | Choo et al. | 704/229 |
| 2012/0010882 | A1 * | 1/2012 | Thyssen et al. | 704/226 |
| 2012/0226496 | A1 * | 9/2012 | Yoon et al. | 704/219 |

OTHER PUBLICATIONS

Bessette et al., "Universal Speech/Audio Coding Using Hybrid Acelp/TCX Techniques", IEEE, vol. 3, Mar. 18-23, 2005, pp. 301-304.

Johnston, "Transform Coding of Audio Signals Using Perceptual Noise Criteria", IEEE Journal on Selected Areas in Communications, vol. 6, No. 2, Feb. 1988, pp. 314-323.

* cited by examiner

FIG. 5

| Syntax | No. of bits | Mnemonic | |
|---|---|---|---|
| USACSpecificConfig (samplingFrequencyIndex, channelConfiguration, audioObjectType) | | | |
| { | | | |
| **frameLengthFlag;** | **1** | **bslbf** | |
| **dependsOnCoreCoder;** | **1** | **bslbf** | |
| **extensionFlag;** | **1** | **bslbf** | |
| if (extensionFlag) { | | | |
| **extensionFlag3;** | **1** | **bslbf** | |
| **tw_mdct;** | **1** | **bslbf** | |
| **noiseFilling;** | **1** | **bslbf** | (L1) |
| If (sbrPresentFlag == 1) { | | | |
| **harmonicSBR;** | **1** | **bslbf** | |
| } | | | |
| **mpegsMuxMode;** | **2** | **uimsbf** | |
| if ( mpegsMuxMode > 0 ) { | | | |
| tmpBits = SpatialSpecificConfig(); | | | |
| } | | | |
| } | | | |
| } | | | |

FIG. 7

| Syntax | No. of bits | Mnemonic | |
|---|---|---|---|
| fd_channel_stream(common_window, common_tw, noiseFilling) | | | (L1) |
| { | | | |
| **global_gain;** | **8** | **uimsbf** | |
| if (noiseFilling) { | | | (L2) |
| **noise_level** | **3** | **uimsbf** | (L3) |
| if(noise_level > 0) | | | (L4) |
| **noise_offset** | **5** | **uimsbf** | (L5) |
| } | | | |
| else { | | | |
| noise_level = 0 | | | |
| } | | | |
| if (!common_window) { | | | |
| ics_info(); | | | |
| } | | | |
| if (tw_mdct) { | | | |
| if ( ! common_tw ) { | | | |
| tw_data(); | | | |
| } | | | |
| } | | | |
| scale_factor_data (); | | | |
| **tns_data_present;** | **1** | **uimsbf** | |
| if (tns_data_present) { | | | |
| tns_data (); | | | |
| } | | | |
| ac_spectral_data (); | | | |
| } | | | |

FIG. 8

| Syntax | No. of bits | Mnemoni | |
|---|---|---|---|
| single_channel_element() | | | |
| { | | | |
| **core_mode** | 1 | **uimsbf** | (L1) |
| if ( core_mode == 1 ) { | | | (L2) |
| lpd_channel_stream(); | | | (L3) |
| } | | | |
| else { | | | (L4) |
| fd_channel_stream(0,0,noiseFilling); | | | (L5) |
| } | | | |
| } | | | |

APPARATUS AND METHOD FOR PROCESSING A TIME DOMAIN AUDIO SIGNAL WITH A NOISE FILLING FLAG

CROSS-REFERENCE TO RELATED APPLICATION

This application claims the benefit of U.S. Provisional Application No. 61/111,323 filed on Nov. 4, 2008, U.S. Provisional Application No. 61/114,478, filed on Nov. 14, 2008, Korean Patent Application No. 10-2009-0105389, filed on Nov. 3, 2009, which are hereby incorporated by reference.

BACKGROUND OF THE INVENTION

1. Field of the Invention

The present invention relates to an apparatus for processing an audio signal and method thereof Although the present invention is suitable for a wide scope of applications, it is particularly suitable for encoding or decoding audio signals.

2. Discussion of the Related Art

Generally, an audio characteristic based coding scheme is applied to such an audio signal as a music signal and a speech characteristic based coding scheme is applied to a speech signal.

However, if one prescribed coding scheme is applied to a signal in which an audio characteristic and a speech characteristic are mixed with each other, audio coding efficiency is lowered or a sound quality is degraded.

SUMMARY OF THE INVENTION

Accordingly, the present invention is directed to an apparatus for processing an audio signal and method thereof that substantially obviate one or more of the problems due to limitations and disadvantages of the related art.

An object of the present invention is to provide an apparatus for processing an audio signal and method thereof, in which a decoder is able to apply a noise filling scheme to compensate a signal lost in the course of quantization for encoding.

Another object of the present invention is to provide an apparatus for processing an audio signal and method thereof, by which a transmission on information on noise filling can be omitted for a frame to which a noise filling scheme is not applied.

A further object of the present invention is to provide an apparatus for processing an audio signal and method thereof, by which information (noise level or noise offset) on noise filling can be encoded based on a characteristic that the information on the noise filling has an almost same value for each frame.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method for processing an audio signal, comprising: extracting noise filling flag information indicating whether noise filling is used to a plurality of frames; extracting coding scheme information indicating whether a current frame included in the plurality of frames is coded in either a frequency domain or a time domain; when the noise filling flag information indicates that the noise filling is used to for the plurality of frames and the coding scheme information indicates that the current frame is coded in the frequency domain, extracting noise level information for the current frame; when a noise level value corresponding to the noise level information meets a predetermined level, extracting noise offset information for the current frame; and, when the noise offset information is extracted, performs the noise-filling for the current frame based on the noise level value and the noise offset information is provided.

According to the present invention, the noise-filling comprises: determining a loss area of the current frame using a spectral data of the current frame; generating a compensated spectral data by filling the loss area with a compensation signal using the noise level value; and generating a compensated scalefactor based on the noise offset information.

According to the present invention, the method further comprises: extracting a level pilot value representing a reference value of a noise level, and an offset pilot value representing a reference value of a noise offset; obtaining the noise level value by summing the level pilot value and the noise level information; and, when the noise offset information is extracted, obtaining a noise offset value by summing the offset pilot value and the noise offset information, wherein the noise filling is performed using the noise level value and the noise offset value.

According to the present invention, the method further comprises obtaining a noise level value of the current frame using a noise level value of a previous frame and the noise level information of the current frame; and, when the noise offset information is extracted, obtaining a noise offset value of the current frame using a noise offset value of the previous frame and the noise offset information of the current frame, wherein the noise filling is performed using the noise level value and the noise offset value.

According to the present invention, both the noise level information and the noise offset information are extracted according to variable length coding scheme.

To further achieve these and other advantages and in accordance with the purpose of the present invention, an apparatus for processing an audio signal, comprising: a multiplexer extracting noise filling flag information indicating whether noise filling is used to a plurality of frames, and coding scheme information indicating whether a current frame included in the plurality of frames is coded in either a frequency domain or a time domain; a noise information decoding part, when the noise filling flag information indicates that the noise filling is used to for the plurality of frames and the coding scheme information indicates that the current frame is coded in the frequency domain, extracting noise level information for the current frame, and when a noise level value corresponding to the noise level information meets a predetermined level, extracting noise offset information for the current frame; and, a loss compensation part, when the noise offset information is extracted, performs the noise-filling for the current frame based on the noise level value and the noise offset information is provided.

According to the present invention, the loss compensation part configured to: determines a loss area of the current frame using a spectral data of the current frame, generate a compensated spectral data by filling the loss area with a compensation signal using the noise level value, and generate a compensated scalefactor based on the noise offset information.

According to the present invention, the apparatus further comprises a data decoding part configured to: extract a level pilot value representing a reference value of a noise level, and an offset pilot value representing a reference value of a noise offset, obtain the noise level value by summing the level pilot value and the noise level information, and, when the noise offset information is extracted, obtain a noise offset value by summing the offset pilot value and the noise offset information, wherein the noise filling is performed using the noise level value and the noise offset value.

According to the present invention, the apparatus of claim 6, further comprising: a data decoding part configured to: obtain a noise level value of the current frame using a noise level value of a previous frame and the noise level information of the current frame, and, when the noise offset information is extracted, obtain a noise offset value of the current frame using a noise offset value of the previous frame and the noise offset information of the current frame, wherein the noise filling is performed using the noise level value and the noise offset value.

According to the present invention, both the noise level information and the noise offset information are extracted according to variable length coding scheme.

To further achieve these and other advantages and in accordance with the purpose of the present invention, a method for processing an audio signal, comprising: generating a noise level value and a noise offset value based on a quantized signal; generating noise filling flag information indicating whether noise filling is used to a plurality of frames; generating coding scheme information indicating whether a current frame included in the plurality of frames is coded in either a frequency domain or a time domain; when the noise filling flag information indicates that the noise filling is used to for the plurality of frames and the coding scheme information indicates that the current frame is coded in the frequency domain, inserting noise level information for the current frame corresponding to the noise level value into a bitstream; and, when the noise level value meets a predetermined level, inserting noise offset information corresponding to the noise offset value into the bitstream is provided.

To further achieve these and other advantages and in accordance with the purpose of the present invention, an apparatus for processing an audio signal, comprising: a loss compensation estimating part generating a noise level value and a noise offset value based on a quantized signal, and noise filling flag information indicating whether noise filling is used to a plurality of frames; a signal classifier generating coding scheme information indicating whether a current frame included in the plurality of frames is coded in either a frequency domain or a time domain; and, a noise information encoding part, when the noise filling flag information indicates that the noise filling is used to for the plurality of frames and the coding scheme information indicates that the current domain is coded in the frequency domain, inserting noise level information for the current frame corresponding to the noise level value into a bitstream; and, when the noise level value meets a predetermined level, inserting noise offset information corresponding to the noise offset value into the bitstream is provided.

To further achieve these and other advantages and in accordance with the purpose of the present invention, a computer-readable medium having instructions stored thereon, which, when executed by a processor, causes the processor to perform operations, comprising: extracting noise filling flag information indicating whether noise filling is used to a plurality of frames; extracting coding scheme information indicating whether a current frame included in the plurality of frames is coded in either a frequency domain or a time domain; when the noise filling flag information indicates that the noise filling is used to for the plurality of frames and the coding scheme information indicates that the current frame is coded in the frequency domain, extracting noise level information for the current frame; when a noise level value corresponding to the noise level information meets a predetermined level, extracting noise offset information for the current frame; and, when the noise offset information is extracted, performs the noise-filling for the current frame based on the noise level value and the noise offset information is provided.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 5 is a diagram for an example of a syntax for encoding noise filing flag information;

FIG. 7 is a diagram for an example of a syntax for encoding a noise level and a noise offset;

FIG. 8 is a diagram for an example of a syntax for encoding coding scheme information;

DETAILED DESCRIPTION OF THE INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

The following terminologies in the present invention can be construed based on the following criteria and other terminologies failing to be explained can be construed according to the following purposes. First of all, it is understood that the concept 'coding' in the present invention can be construed as either encoding or decoding in case. Secondly, 'information' in this disclosure is the terminology that generally includes values, parameters, coefficients, elements and the like and its meaning can be construed as different occasionally, by which the present invention is non-limited.

In this disclosure, in a broad sense, an audio signal is conceptionally discriminated from a video signal and designates all kinds of signals that can be auditorily identified. In a narrow sense, the audio signal means a signal having none or small quantity of speech characteristics. Audio signal of the present invention should be construed in a broad sense. And, the audio signal of the present invention can be understood as a narrow-sense audio signal in case of being used by being discriminated from a speech signal.

Figure 1:
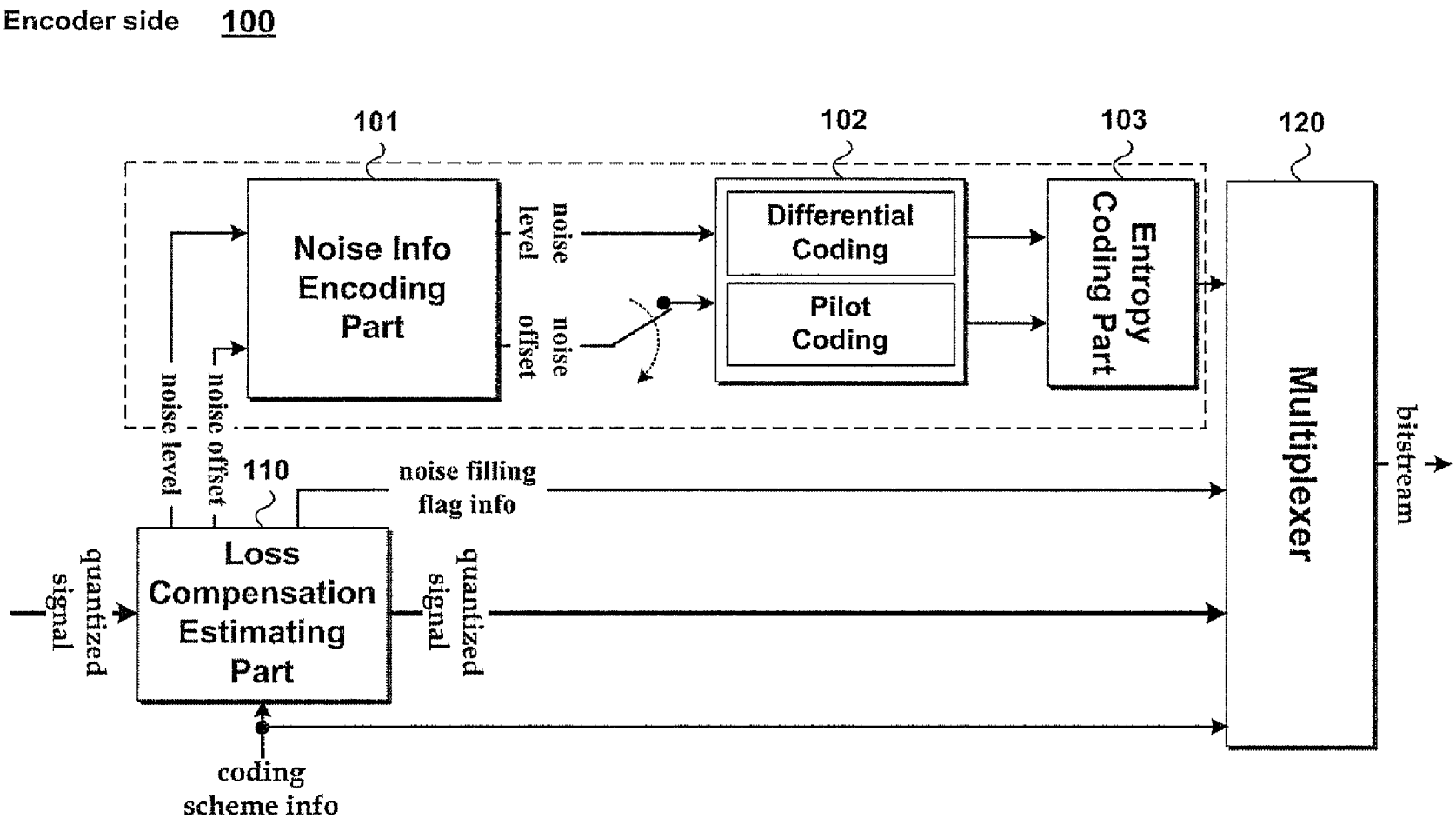
FIG. 1 is a block diagram of an encoder side in an audio signal processing apparatus according to an embodiment of the present invention.
Figure 2:
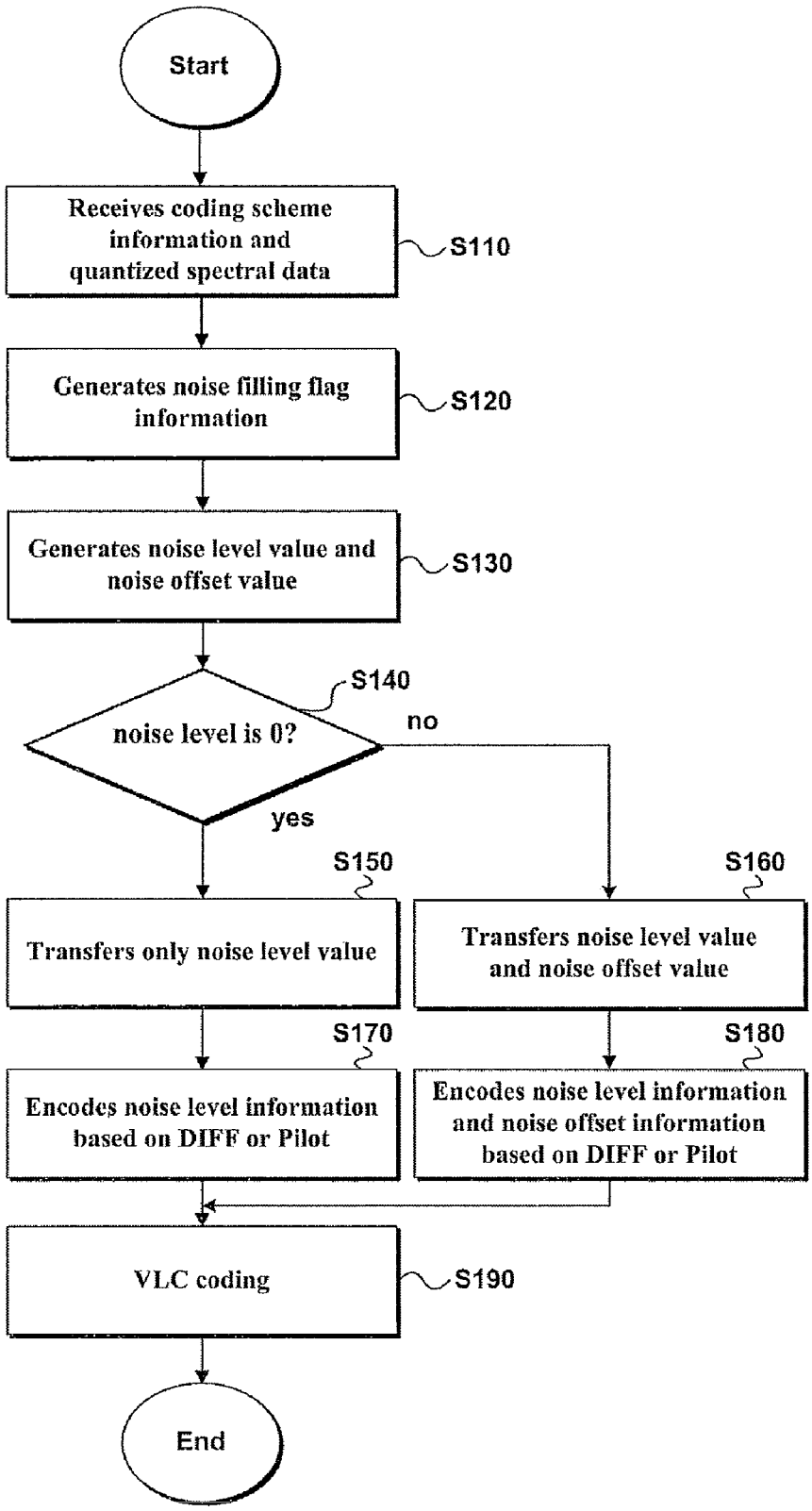
FIG. 2 is a flowchart for an encoding scheme in an audio signal processing method according to an embodiment of the present invention.

FIG. 1 is a block diagram for a diagram of an encoder side in an audio signal processing apparatus according to one embodiment of the present invention. And, FIG. 2 is a flowchart for an encoding scheme in an audio signal processing method according to an embodiment of the present invention.

Referring to FIG. 1, an encoder side 100 in an audio signal processing apparatus includes a noise information encoding part 101 and is able to further include a data encoding part 102, an entropy coding part 103, a loss compensation estimating part 110 and a multiplexer 120. The audio signal processing apparatus according to the present invention encodes a noise offset based on a noise level.

The loss compensation estimating part 110 generates information on noise filling based on a quantized signal In this case, the information on the noise filling can include noise filling flag information, noise level, noise offset or the like.

In particular, the loss compensation estimating part 110 firstly receives a quantized signal and a coding scheme information (step S110). The coding scheme information is the information that indicates whether a frequency domain based scheme or a time domain based scheme is applied to a current frame. And, the coding scheme information can be the information generated by a signal classifier (not shown in the drawing). The loss compensation estimating part 110 is able to generate the information on the noise filling in case of a frequency domain signal only. This coding scheme information can be delivered to the multiplexer 120. And, an example of a syntax for encoding the coding scheme information will be explained later in this disclosure.

Meanwhile, quantization is a process for obtaining a scale factor and spectral data from a spectral coefficient. In this case, each of the scale factor and the spectral data is a quantized signal. The spectral coefficient can include an MDCT coefficient obtained through MDCT (modified discrete cosine transform), by which the present invention is non-limited. In other words, the spectral coefficient can be similarly expressed using a scale factor of integer and a spectral data of integer, as shown in Formula 1.

$$X \cong 2^{\frac{scalefactor}{4}} \times \text{spectral_data}^{\frac{4}{3}} \qquad \text{[Formula 1]}$$

In Formula 1, 'X' is a spectral coefficient, 'scalefactor' indicates a scale factor, and 'spectral_data' indicates a spectral data.

Figure 3:
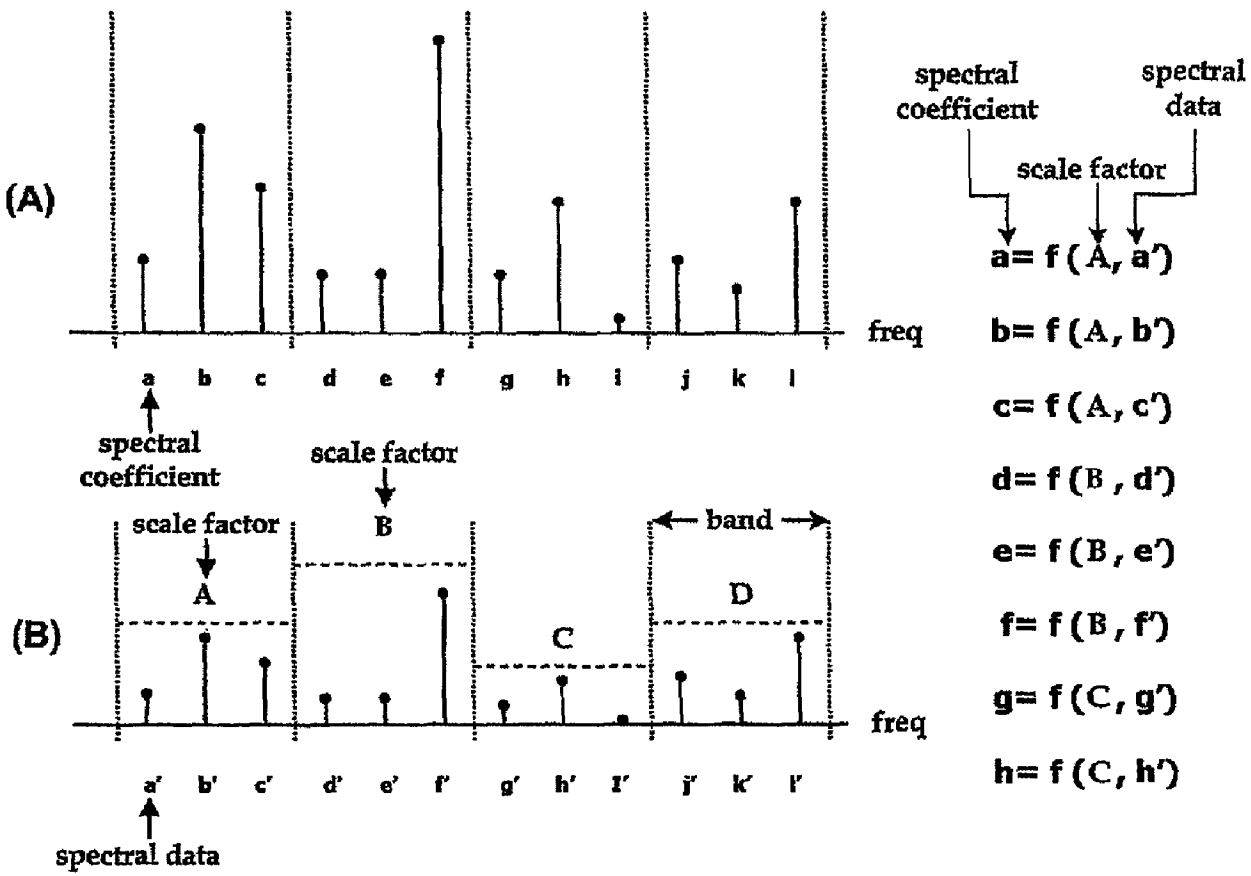
FIG. 3 is a diagram for explaining the concept of quantization.

FIG. 3 is a diagram for explaining the concept of quantization.

Referring to FIG. 3, a procedure for expressing a spectral coefficient (a, b, c, etc.) as a scale factor (A, B, C, etc.) and a spectral data (a', b', c', etc.) is conceptionally represented. The scale factor (A, B, C, etc.) is the factor applied to a group (e.g., a specific band, a specific interval, etc.). Thus, using a scale factor representing a prescribed group (e.g., a scale factor band), it is able to raise coding efficiency by transforming sizes of coefficients belonging to the corresponding group collectively. The scale factor and data determined in the above manner can be used as they are. As the determined scale factor and data can be modified by a masking process based on a psychoacoustic model, of which details are omitted from the following description.

Figure 4:
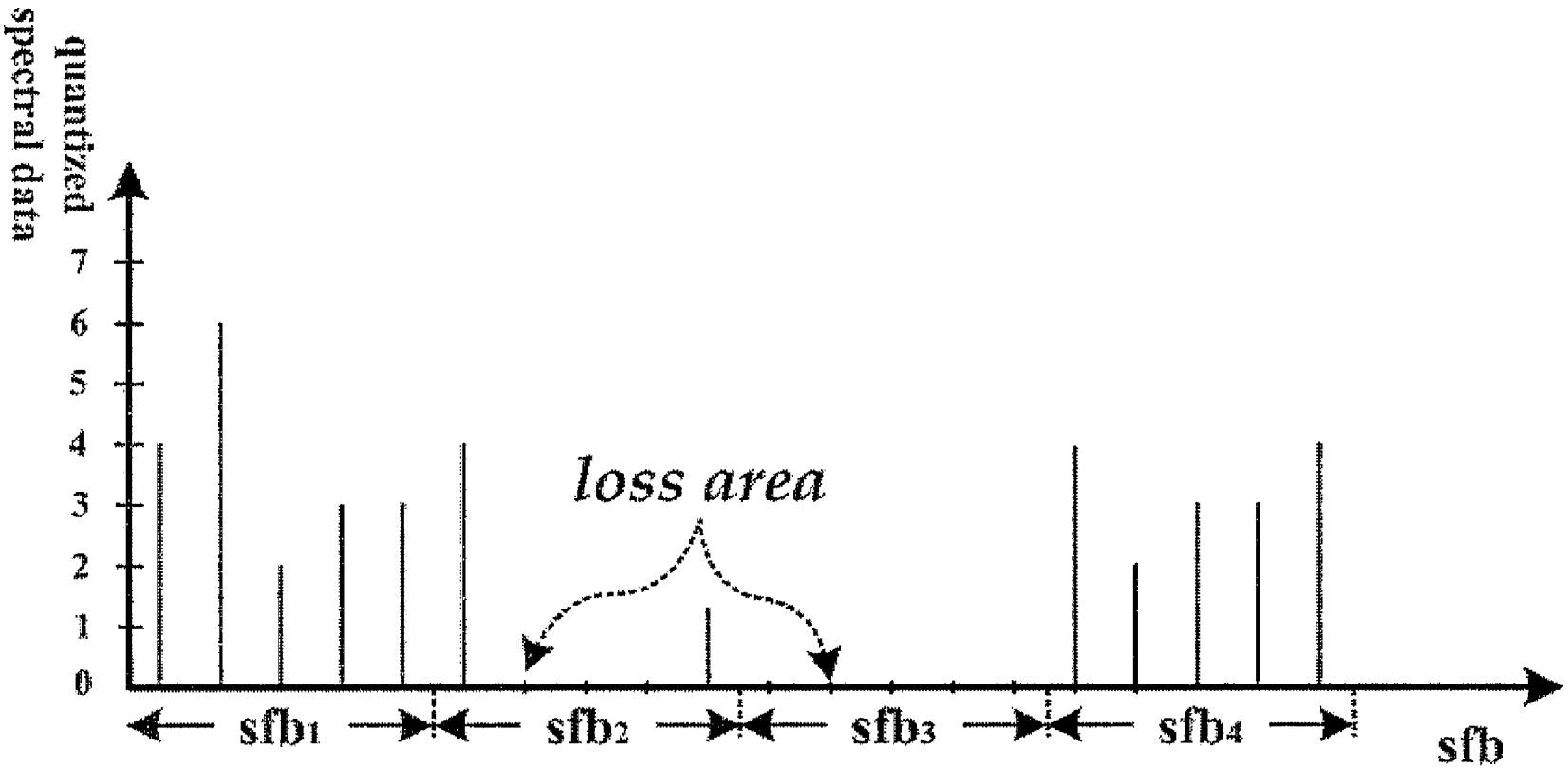
FIG. 4 is a diagram for explaining the concepts of loss signal and loss area.

The loss compensation estimating part 110 determines a loss area, which a loss signal exists, based on the spectral data. FIG. 4 is a diagram for explaining the concepts of loss signal and loss area. Referring to FIG. 4, it can be observed that at least one spectral data exists for each spectral band $sfb_1$, $sfb_2$ or $sfb_4$. Each of the spectral data corresponds to an integer value between 0 and 7. The spectral data can be one value among from −50 to 100 rather than from 0 to 7, because FIG. 4 is one example for explaining the concept, which does not put limitations on the present invention. If a absolute value of spectral data indicates a value equal to or smaller than a specific value e.g., 0) in a prescribed sample, bin or region, it can be determined that a signal is lost or a loss area exists. If a specific value is 0 in case of FIG. 4, it can be observed that a loss signal is generated from each of the second and third spectral bands $sfb_2$ and $sfb_3$. In case of the third spectral band $sfb_3$, it can be observed that a whole band corresponds to a loss area.

In order to compensate the loss area for the loss signal, the loss compensation estimating part 110 determines whether to use a noise filling scheme for a plurality of frames or one sequence and then generates noise filling flag information based on this determination. In particular, the noise filling flag information is the information that indicates whether the noise filling scheme is used to compensate a plurality of frames or a sequence for the loss signal. Meanwhile, the noise filling flag information does not indicate whether the noise filling scheme is used for a plurality of frames or all frames belonging to a sequence but indicates whether it is possible to use the noise filling scheme for a specific one of the frames. The noise filling flag information can be included in a header corresponding to the information common to a plurality of the frames or a whole sequence. In this case, the generated noise filling flag information is delivered to the multiplexer 120. FIG. 5 is a diagram for an example of a syntax for encoding noise filing flag information. Referring to (L1) in FIG. 5, it can be observed that the noise filling flag information (noise-filling) is included in a header (USACSpecificConfig( ) for carrying the information (e.g., frame length, whether to use eSBR, etc.) commonly applied to a whole sequence. If the noise filling flag information is set to 0, it means that the noise filling scheme is not usable for a whole sequence. Otherwise, if the noise filling flag information is set to 1, it can mean that the noise filling scheme is usable for at least one frame included in a whole sequence.

Figure 6:
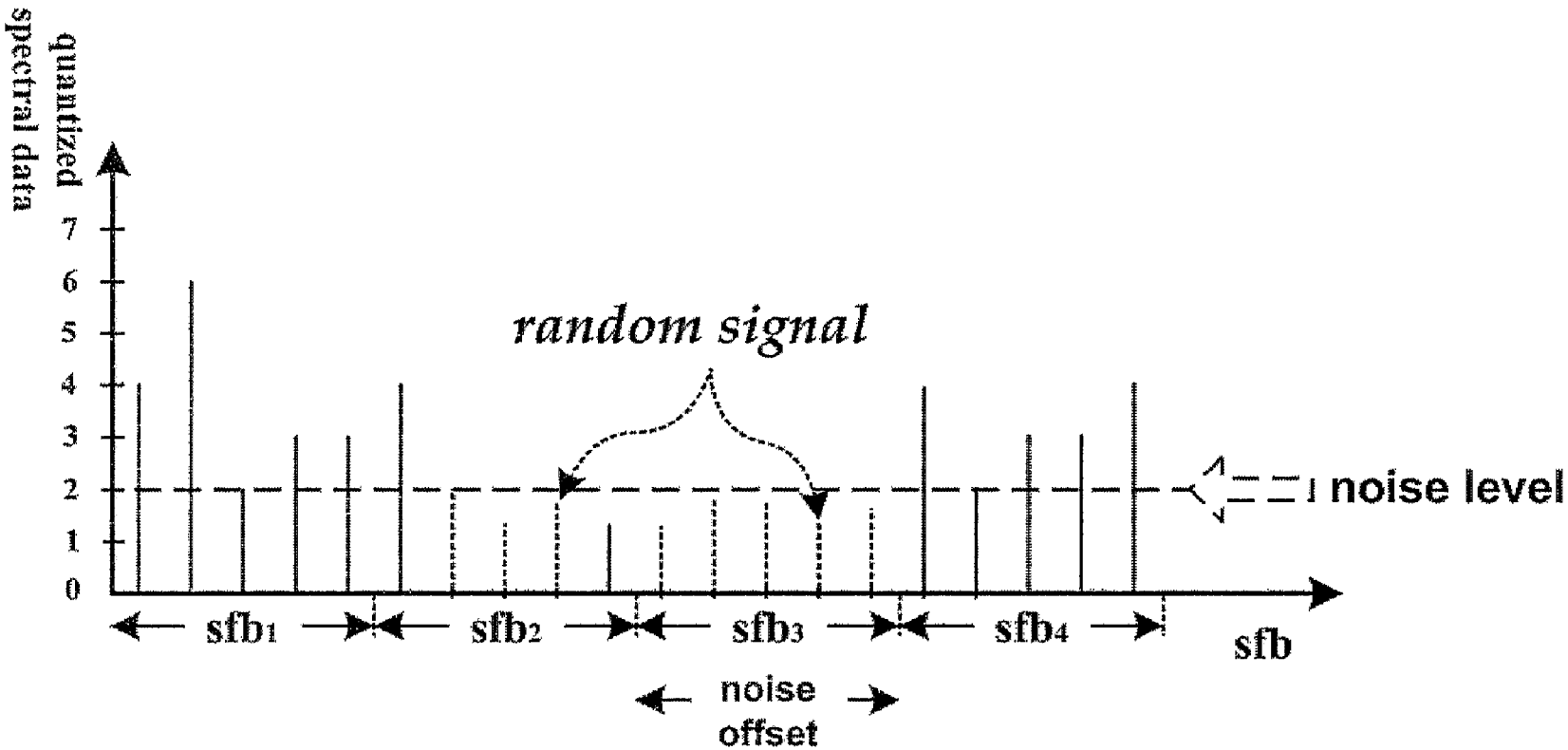
FIG. 6 is a diagram for explaining a noise level and a noise offset.

Referring now to FIG. 1 and FIG. 2, the loss compensation estimating part 110 generates a noise level and a noise offset for a loss area in which a loss signal exists [step S130]. FIG. 6 is a diagram for explaining a noise level and a noise offset. Referring to FIG. 6, it is able to generate a compensation signal (e.g., a random signal) for an area from which a spectral data is loss on behalf of the loss signal. In this case, the noise level is the information for determining a level of the compensation signal. The noise level and the compensation signal (e.g., random signal) can be expressed as Formula 2. In particular, the noise level can be determined for each frame.

$$\text{spectral_data}=\text{noise_}val\times\text{random_signal} \quad \text{[Formula 2]}$$

In Formula 2, spectral_data indicates spectral data, noise_val indicates value obtained using a noise level, and random_signal indicates a random signal.

Meanwhile, the noise offset is the information for modifying a scale factor. As mentioned in the foregoing description, the noise level is a factor for modifying the spectral data in Formula 2. Yet, a range of a value of the noise level is limited. For a loss area, in order to provide a great value to a spectral coefficient, it may be more efficient to modify the scale factor rather than to modify the spectral data through the noise level. In doing so, the value for modifying the scale factor is the noise offset. And, the relation between the noise offset and the scale factor can be expressed as Formula 3.

$$sfc_d=sfc_c-\text{noise_offset} \quad \text{[Formula 3]}$$

In Formula 3, sfc_c is a scale factor, sfc_d is a transferred scale factor, and noise_offset is a noise offset.

In this case, the noise offset may be applicable only if a whole spectral band corresponds to a loss area. For instance, a noise offset is applicable to the third spectral band $sfb_3$ only. When a loss area exists in one spectral band in part, if a noise offset is applied, the bit number of a spectral data corresponding to a non-loss area may be incremented to the contrary.

The noise information encoding part 101 encodes the noise offset based on the noise level and offset values received from the loss compensation estimating part 110. For instance, only if the noise level value meets a prescribed condition (e.g., a specific level range), it is able to encode a noise offset value. For instance, if a noise level value exceeds 0 ['no' in the step S140], a noise filling scheme is executed. Hence, by delivering the noise offset value to the data coding part 102, the noise offset information can be included in a bitstream [step S160].

On the contrary, if a noise level value is 0 ['yes' in the step S140], it corresponds to a case that a noise filling scheme is not executed. Hence, the noise level value set to 0 is encoded only. And, the noise offset value is excluded from a bitstream [step S150].

FIG. 7 is a diagram for an example of a syntax for encoding a noise level and a noise offset. Referring to a row (L1) in FIG. 7, it can be observed that a current frame corresponds to a frequency domain signal. Referring to a row (L2) and a row (L3), it can be observed that a noise level information noise) level is included in a bitstream only if a noise filling flag information (noisefilling) is 1. If the noise filling flag information (noisefilling) is 0, it means that the noise filling is not applied to a whole sequence to which a current frame belongs. Referring to a row (L4) and a row (L5), it can be observed that the noise offset information (noise_offset) is included in a bitstream only if a noise level value is greater than 0.

Referring now to FIG. 1 and FIG. 2, the data coding part 102 performs data coding on the noise level value (and the noise offset value) using a differential coding scheme or a pilot coding scheme. In this case, the differential coding scheme is the scheme for transferring a difference value between a noise level value of a previous frame and a noise level value of a current frame and can be expressed as Formula 4.

$$\text{noise_}info_diff_cur=\text{noise_}info_cur-\text{noise_}info_prev \quad \text{[Formula 4]}$$

In Formula 4, noise_info_cur indicates a noise level (or offset) of a current frame, noise_info_prev indicates a noise level (or offset) of a previous frame, and noise_info_diff_cur indicates a difference value.

Thus, a difference value, which results from subtracting a noise level (or offset) of a previous frame from the noise level (received from the noise information encoding part 101) of the current frame, is delivered to the entropy coding part 103 only.

Meanwhile, the pilot coding scheme determines a pilot value as a reference value (e.g., an average, intermediate, most frequent value of noise levels (or offsets) of total N frames, etc.) amounting to a noise level (or offset) value corresponding to at least two frames and then transfers a difference value between this pilot value and a noise level (or offset) of a current frame.

$$\text{noise_}info_diff_cur=\text{noise_}info_cur-\text{noise_}info_\text{pilot} \quad \text{[Formula 5]}$$

In Formula 5, the noise_info_diff_cur indicates a noise level (or offset) of a current frame, the noise_info_cur indicates a pilot of a noise level (or offset), and the noise_info_pilot indicates a difference value.

In this case, the pilot of the noise level (or offset) can be carried on a header. In this case, the header may be identical to the former header that carries the noise filling flag information.

In case that the differential coding scheme or the pilot coding scheme is applied, a noise level value of a current frame does not become a noise live information included in a bitstream as it is. Instead, a difference value (a difference value of DIFF coding, a difference value of pilot coding) of a noise level value becomes a noise level information.

Thus, when the noise level value becomes the noise level information by performing differential coding or pilot coding [S170, S180], if the noise offset value is generated, a noise offset information is generated by performing the differential coding or the pilot coding on the noise offset value as well [step s180]. This noise level information (and the noise offset information) is delivered to the entropy coding part 103.

The entropy coding part 103 performs entropy coding on the noise level information (and the noise offset information). If the noise level information (and the noise offset information) is coded by the data coding part 102 according to the differential coding scheme or the pilot coding scheme, an information corresponding to the difference value can be encoded according to a variable length coding scheme (e.g., Huffman coding) corresponding to one of entropy coding schemes. Since this difference value is set to 0 or a value approximate to 0, it is able to further reduce the number of bits if encoding is performed according to the variable length coding scheme instead of using fixed bits.

The multiplexer 120 generates a bitstream by multiplexing the coding scheme information received from the signal classifier (not shown in the drawing), the noise level information (and the noise offset information) received via the entropy coding part 103 and the noise filling flag information and the quantized signal (spectral data and scale factor) received via the loss compensation estimating part 110 together. The syntax for encoding the noise filling flag information can be the same as shown in FIG. 5. And, the syntax for encoding the noise level information (and the noise offset information) can be the same as shown in FIG. 7.

FIG. 8 is a diagram for an example of a syntax for encoding coding scheme information. Referring to (L1) shown in FIG. 8, it can be observed that a coding scheme information (core_mode) indicating whether a frequency domain based scheme or a time domain based scheme is applied to a current frame is included. Referring to a row (L2) and a row (L3), if the coding scheme information indicates that the time domain based scheme is applied, it can be observed that a time domain base channel stream is transported. Referring to a row (L4) and a row (L5), if the coding scheme information indicates that the frequency domain based scheme is applied, it can be observed that a frequency domain base channel stream is transported. As mentioned in the foregoing description, the frequency domain based channel stream (fd_channel_stream( )) can include the information (noise level information (and noise offset information)) on the noise filling, as mentioned in the foregoing description with reference to FIG. 7.

Therefore, in an audio signal encoding apparatus and method according to an embodiment of the present invention, encoding is performed on information (particularly, noise offset information) on noise filling according to whether a noise filling scheme is actually applied to a specific frame in a sequence for which the noise filling scheme is available. Optionally, the encoding can be skipped.

Figure 9:
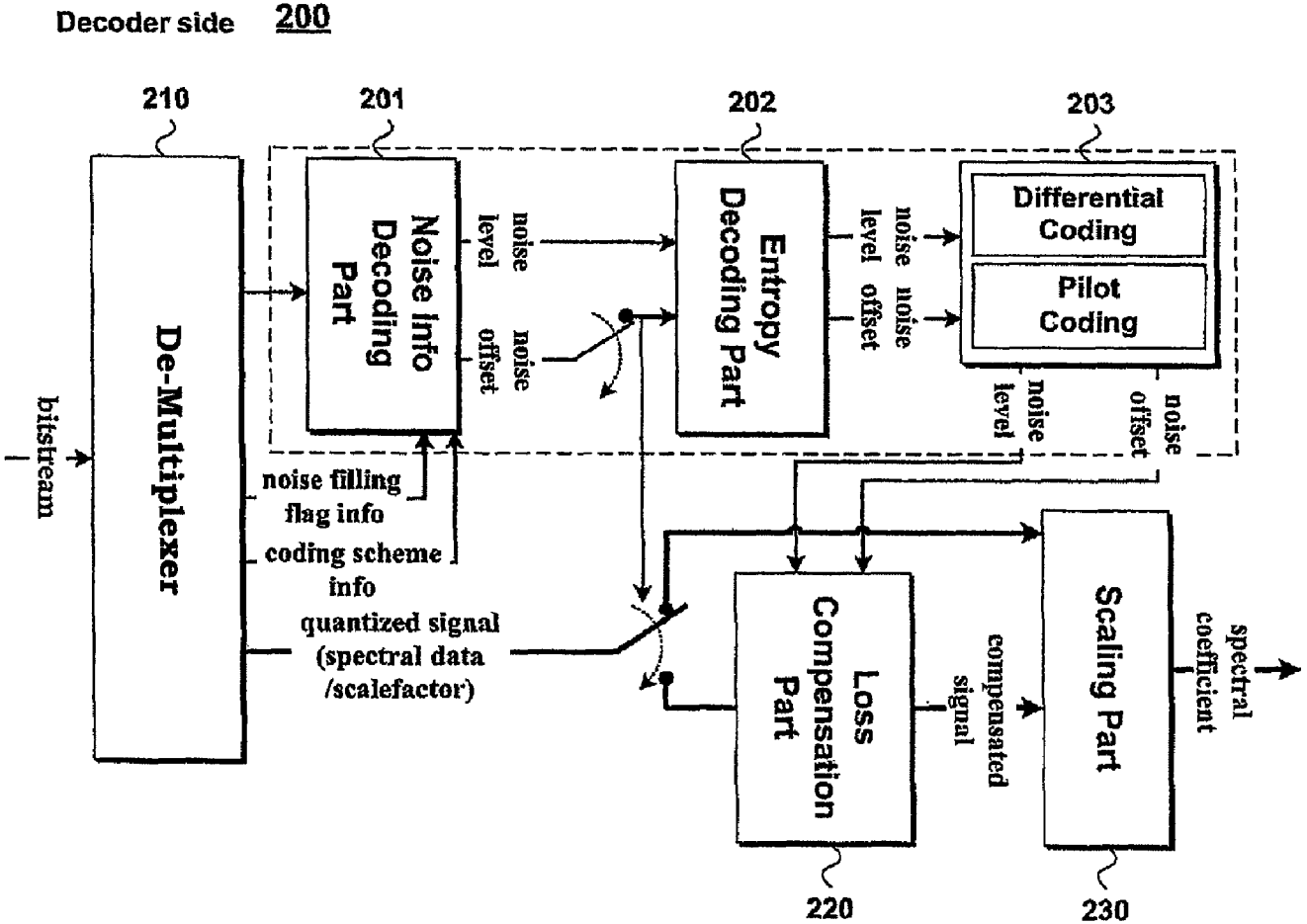
FIG. 9 is a bock diagram of a decoder side in an audio signal processing apparatus according to an embodiment of the present invention.
Figure 10:
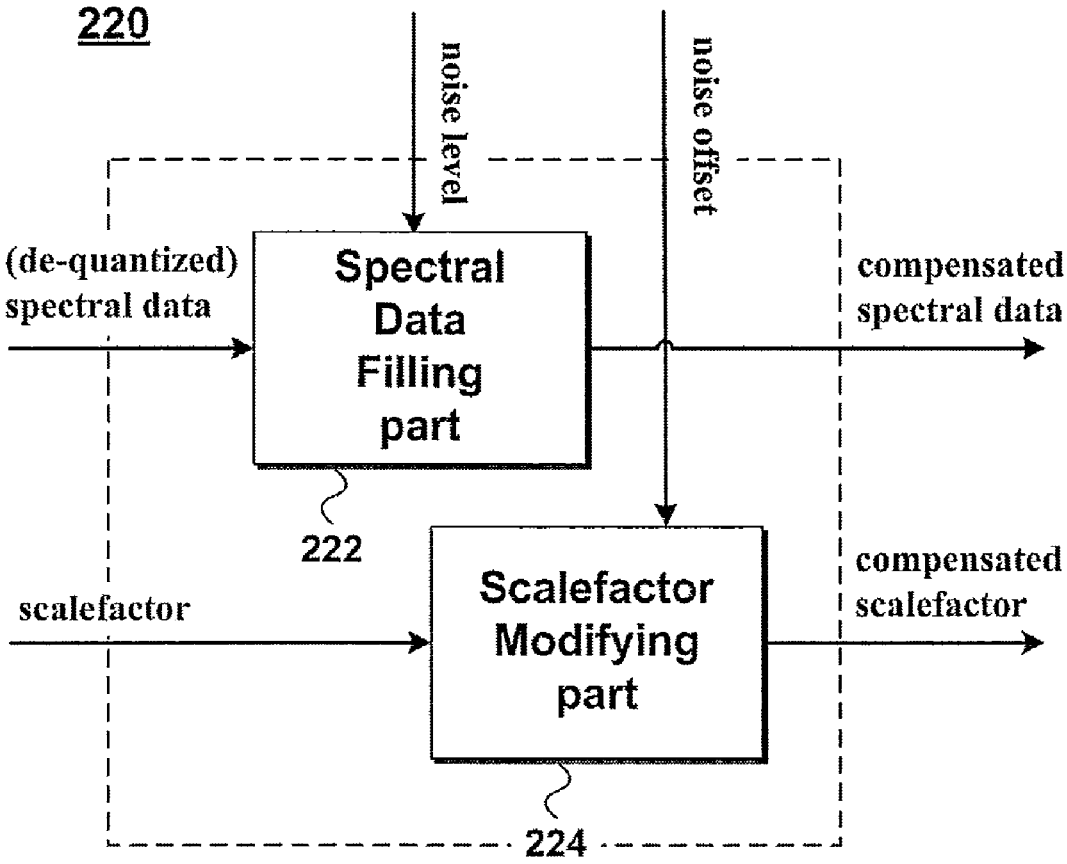
FIG. 10 is a detailed block diagram of a loss compensation part shown in FIG. 9.
Figure 11:
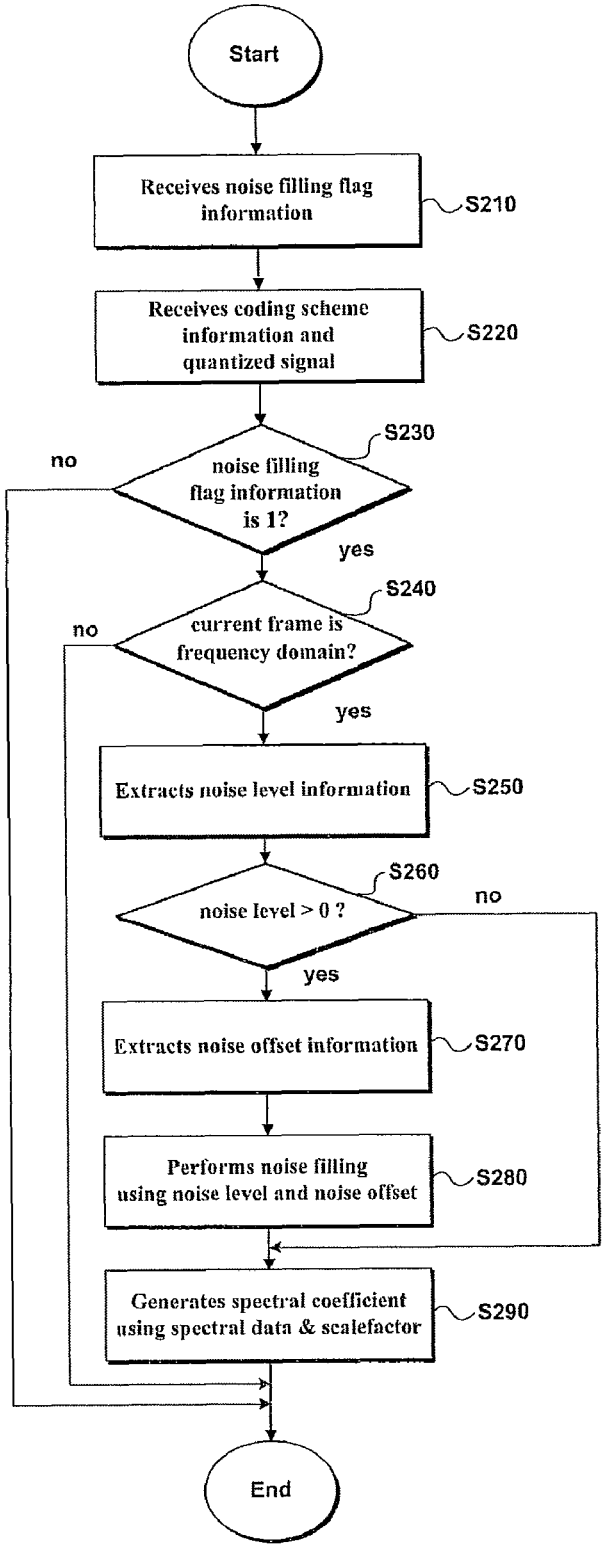
FIG. 11 is a flowchart for a decoding scheme in an audio signal processing method according to an embodiment of the present invention.

FIG. 9 is a bock diagram of a decoder side in an audio signal processing apparatus according to an embodiment of the present invention, FIG. 10 is a detailed block diagram of a loss compensation part shown in FIG. 9, and FIG. 11 is a flowchart for a decoding scheme in an audio signal processing method according to an embodiment of the present invention.

Referring to FIG. 9 and FIG. 11, a decoder side 200 in an audio signal processing apparatus includes a noise information decoding part 201 and is able to further include an entropy decoding part 202, a data decoding part 203, a demultiplexer 210, a loss compensation part 220 and a scaling part 230.

First of all, the demultiplexer 210 extracts a noise filling flag information from a bitstream (particularly, a header). Subsequently, a coding scheme information on a current frame and a quantized signal are received [step S220]. The noise filling flag information, the coding scheme information and the quantized signal are equal to those explained in the foregoing description. Namely, the noise filing flag information is the information indicating whether a noise filling scheme is used for a plurality of frames. The coding scheme information is the information indicating whether a frequency domain based scheme or a time domain based scheme is applied to a current one of a plurality of the frames. In case that the frequency domain scheme is applied, the quantized signal can include a spectral data and a scale factor. In this case, the noise filling information can be extracted according to the syntax shown in FIG. 5. And, the coding scheme information can be extracted according to the syntax shown in FIG. 8. The noise filling information and the coding scheme information, which are extracted by the multiplexer 210, are delivered to the noise information decoding part 201.

The noise information decoding part 201 extracts the information (noise level information, noise offset information) on the noise filling from the bitstream based on the noise filling flag information and the coding scheme information. In particular, if the noise filling flag information indicates that the noise filling scheme is usable for a plurality of frames ['yes' in the step S230] and the frequency domain based scheme is applied to the current frame ['yes' in the step S240], the noise information decoding part 201 extracts the noise level information from the bitstream [step S250]. The S240 step can be performed prior to the S230 step. The steps S230 to S250 can be performed according to the syntax shown in the rows (L1) to (L3) shown in FIG. 7. As mentioned in the foregoing description with reference to FIG. 6, the noise level information is the information on a level of a compensation signal (e.g., a random signal) inserted in an area (a sample or a bin) from which a spectral data is lost.

In the step S230, in case that the noise filling flag information indicates that the noise filing scheme is not usable for one of a plurality of the frames as well ['no' in the step S230], the routine may end without performing any step for the noise filling In the step S240, if the current frame is the frame having the time domain based scheme applied thereto ['no' in the step S240], the procedure for the noise filling may not be performed.

A de-quantizing part generates de-quantized spectral data by de-quantizing the received spectral data. The de-quantized spectral data is generated by multiplying received spectral data 4/3 times as shown the formula 1.

When the noise level information is extracted in the step S250, if a noise level is greater than 0 (because the noise filling scheme is applied to the current frame)('yes' of step S260), the noise information decoding part 201 extracts the noise offset information from the bitstream [step S270]. The step S260 and the step S270 can be performed according to the syntax shown in the row (L4) and the row (L5) of FIG. 7. As mentioned in the foregoing description with reference to FIG. 6, the noise offset information is the information for modifying a scale factor corresponding to a specific scale factor band. In this case, the specific scale factor band may include a scale factor band in which all spectral data are lost. If this noise offset information is obtained, de-quantized spectral data and scalefactor for the current frame passes through the loss compensation part 220. If the noise offset information is not obtained, the de-quantized spectral data and scalefactor for the current frame bypasses the loss compensation part 220 and is directly inputted to the scaling part 230.

The noise level information extracted in the step S250 and the noise offset information extracted in the step S270 are entropy-decoded by the entropy decoding part 202. In this case, if the informations are encoded according to a variable length coding scheme (e.g., Huffman coding) corresponding to one of entropy coding schemes, they can be entropy-decoded according to the variable length decoding scheme.

The data decoding part 203 performs data decoding on the entropy-decoded noise level information according to a differential scheme or a pilot scheme. In case that the differential coding (DIFF coding) is used, it is able to obtain a noise level (or offset) of a current frame according to the following formula.

$$\text{noise_}info_cur = \text{noise_}info_prev + \text{noise_}info_diff_cur \quad \text{[Formula 6]}$$

In Formula 6, noise_info_cur indicates a noise level (or offset) of a current frame, noise_info_prev indicates a noise level (or offset) of a previous frame, and noise_info_diff_cur indicates a difference value.

In case that the pilot coding is used, it is able to obtain a noise level (or offset) of a current frame according to the following formula.

$$\text{noise_}info_cur = \text{noise_}info_\text{pilot} + \text{noise_}info_diff_cur \quad \text{[Formula 7]}$$

In Formula 7, noise_info_cur indicates a noise level (or offset) of a current frame, noise_info_pilot indicates a pilot of the noise level (or offset), and noise_info_diff_cur indicates a difference value.

In this case, the pilot of the noise level (or offset) can be the information included in a header. The noise level (and noise offset) obtained in the above manner is delivered to the loss compensation part 220.

In case that both of the noise level and the noise offset are obtained, the loss compensation part 220 performs noise filling on the current frame based on the obtained noise level and offset [step S280]. Detailed block diagram of the loss compensation part 220 is shown in FIG. 10.

Referring to FIG. 10 the loss compensation part 220 includes a spectral data filling part 222 and a scale factor modifying part 224. The spectral data filling part 222 determines whether a loss area exists in the spectral data belonging to the current frame. And, the spectral data filling part 222 fills the loss area with a compensation signal using the noise level. As a result of parsing the received spectral data, if the spectral data is equal to or smaller than a prescribed value (e.g., 0), the corresponding sample is determined as the loss area. This loss area can be the same as shown in FIG. 4. As expressed in Formula 2, it is able to generate spectral data corresponding to the loss area by applying the noise level value to the compensation signal (e.g., a random signal). Thus, the compensated spectral data can be generated in a manner of filling the loss area with the compensation signal.

The scale factor modifying part 224 compensates the received scale factor with the noise offset. It is able to compensate a scale factor according to the following formula.

$$sfc_c = sfc_d + \text{noise offset} \quad \text{[Formula 8]}$$

In Formula 8, sfc_c indicates a compensated scale factor, sfc_d indicates a transferred scale factor, and noise_offset indicates a noise offset.

As mentioned in the foregoing description, in case that a whole scale factor bands corresponds to a loss area, the compensation of the noise offset can be performed on the scale factor band only. The spectral data generated by the loss compensation part 220 and the compensated scale factor are inputted to the scaling part 230 shown in FIG. 9.

Referring now to FIG. 9 and FIG. 11, the scaling part 230 scales either the received spectral data or the compensated spectral data using received scalefactor or compensated scalefactor [step S290]. In this case, the scaling is to obtain a spectral coefficient by the following formula using the dequantized spectral data (spectral_data$^{4/3}$ in the following formula) and scale factor.

$$X' = 2^{\frac{scalefactor}{4}} \times \text{spectral_data}^{\frac{4}{3}} \quad \text{[Formula 9]}$$

In Formula 9, X' indicates a restored spectral coefficient, spectral_data is a received or compensated spectral data, and scalefactor indicates a received or compensated scale factor.

A decoder side in an audio signal processing apparatus according to an embodiment of the present invention performs noise filling in a manner of obtaining information on noise filling by performing the above-mentioned steps.

Figure 12:
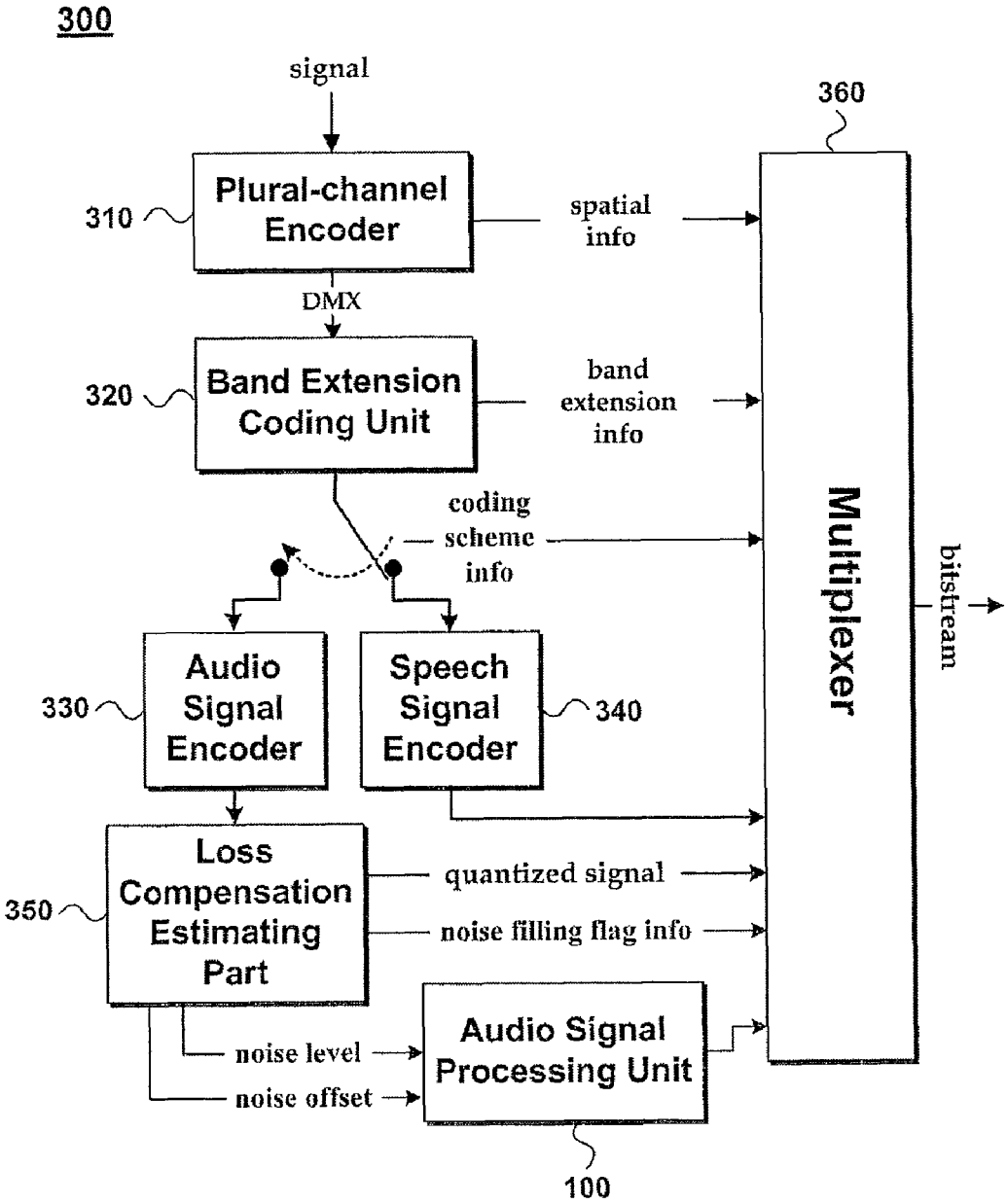
FIG. 12 is a block diagram for an example of an audio signal encoding device to which an audio signal processing apparatus according to an embodiment of the present invention is applied.
Figure 13:
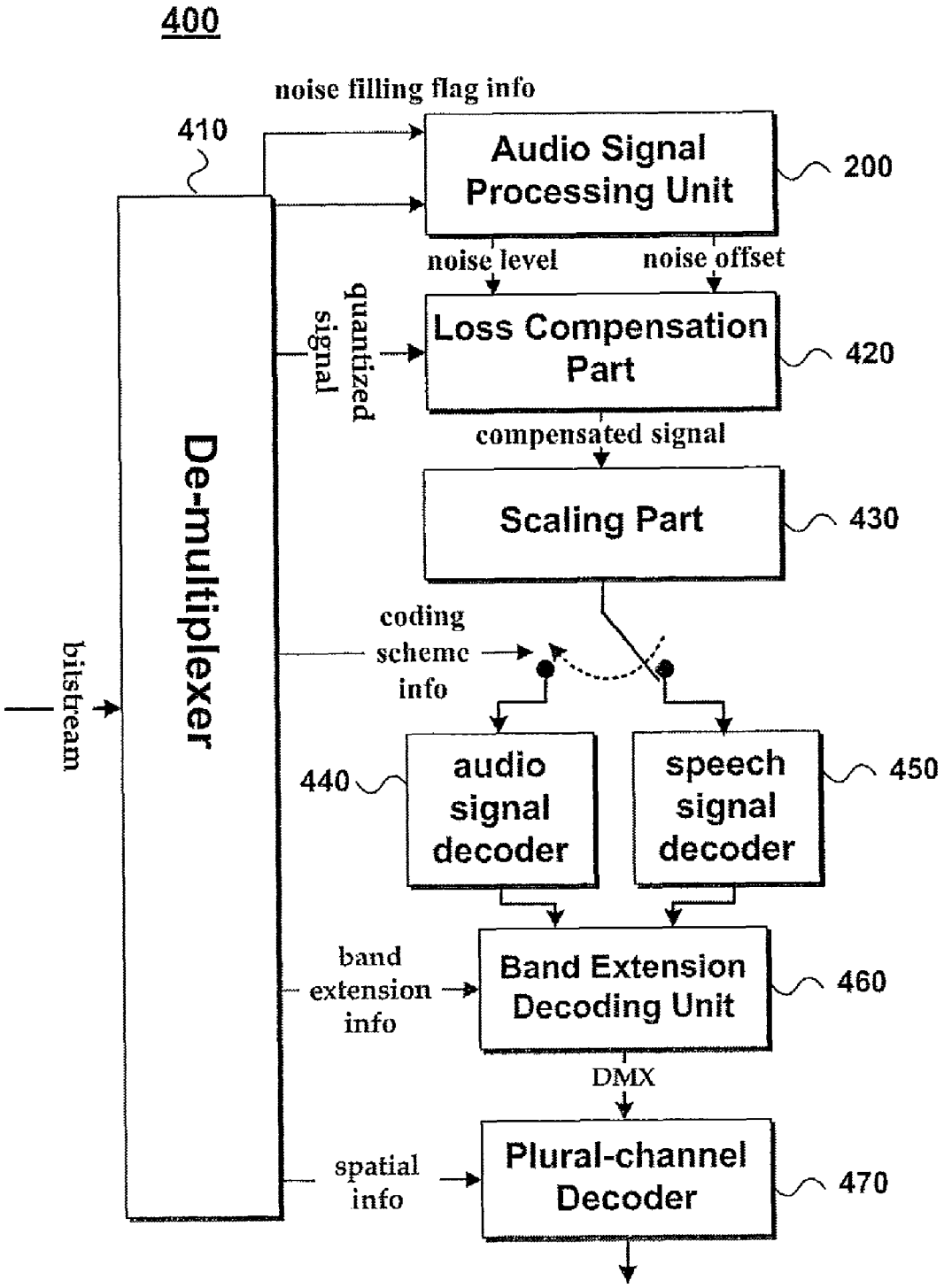
FIG. 13 is a block diagram for an example of an audio signal decoding device to which an audio signal processing apparatus according to an embodiment of the present invention is applied.

FIG. 12 is a block diagram for an example of an audio signal encoding device to which an audio signal processing apparatus according to an embodiment of the present invention is applied. And, FIG. 13 is a block diagram for an example of an audio signal decoding device to which an audio signal processing apparatus according to an embodiment of the present invention is applied.

An audio signal processing apparatus 100 shown in FIG. 12 includes the noise information encoding part 101 described with reference to FIG. 1 and is able to further include the data coding part 102 and the entropy coding part 103. An audio signal processing apparatus 200 shown in FIG. 13 includes the noise information decoding part 201 described with reference to FIG. 9 and is able to further include the entropy decoding part 201 and the data decoding part 203.

Referring to FIG. 12, an audio signal encoding device 300 includes a plural channel encoder 310, a band extension coding unit 320, an audio signal encoder 330, a speech signal encoder 340, a loss compensation estimating unit 350, an audio signal processing apparatus 100 and a multiplexer 360.

The plural channel encoder 310 receives an input of a plural channel signal (a signal having at least two channels) (hereinafter named a multi-channel signal) and then generates a mono or stereo downmix signal by downmixing the multi-channel signal and, the plural channel encoder 310 generates spatial information for upmixing the downmix signal into the multi-channel signal. In this case, the spatial information can include channel level difference information, inter-channel correlation information, channel prediction coefficient, downmix gain information and the like. If the audio signal encoding device 300 receives a mono signal, it is understood that the mono signal can bypass the plural channel encoder 310 without being downmixed.

The band extension encoder 320 is able to generate spectral data corresponding to a low frequency band and band extension information for high frequency band extension in a manner of applying a band extension scheme to the downmix signal that is an output of the plural channel encoder 310. In particular, spectral data of a partial band (e.g., a high frequency band) of the downmix signal is excluded. And, the band extension information for reconstructing the excluded data can be generated.

The signal generated via the band extension coding unit 320 is inputted to the audio signal encoder 330 or the speech signal encoder 340.

If a specific frame or segment of the downmix signal has a large audio characteristic, the audio signal encoder 330 encodes the downmix signal according to an audio coding scheme. In this case, the audio coding scheme may follow the AAC (advanced audio coding) standard or HE-AAC (high efficiency advanced audio coding) standard, by which the present invention is non-limited. Meanwhile, the audio signal encoder 330 can include a modified discrete cosine transform (MDCT) encoder.

If a specific frame or segment of the downmix signal has a large speech characteristic, the speech signal encoder 340 encodes the downmix signal according to a speech coding scheme. In this case, the speech coding scheme may follow the AMR-WB (adaptive multi-rate wideband) standard, by which the present invention is non-limited. Meanwhile, the speech signal encoder 340 can further use a linear prediction coding (LPC) scheme. If a harmonic signal has high redundancy on a time axis, it can be modeled by linear prediction for predicting a present signal from a past signal. In this case, if the linear prediction coding scheme is adopted, it is able to raise coding efficiency. Besides, the speech signal encoder 340 can correspond to a time domain encoder.

The loss compensation estimating unit 350 may perform the same function of the former loss compensation estimating unit 110 described with reference to FIG. 1, of which details are omitted from the following description.

The audio signal processing unit 100 includes the noise information encoding part 101 described with reference to FIG. 1 and then encodes the noise level and the noise offset generated by the loss compensation estimating unit 350.

And, the multiplexer 350 generates at least one bitstream by multiplexing the spatial information, the band extension information, the signals respectively encoded by the audio signal encoder 330 and the speech signal encoder 340, the noise filling flag information and the noise level information (and noise offset information) generated by the audio signal processing unit 110 together.

Referring to FIG. 13, an audio signal decoding device 400 includes a demultiplexer 410, an audio signal processing apparatus 200, a loss compensation part 420, a scaling part 430, an audio signal decoder 440, a speech signal decoder 450, a band extension decoding unit 460 and a plural channel decoder 470.

The demultiplexer 410 extracts a noise filling flag information, a quantized signal, a coding scheme information, a band extension information, a spatial information and the like from an audio signal bitstream.

As mentioned in the foregoing description, the audio signal processing unit 200 includes the noise information decoding unit 201 described with reference to FIG. 9 and obtains a noise level information (and noise offset information) from the bitstream based on the noise filling flag information and the coding scheme information.

A de-quantized unit configured to transfer the de-quantized spectral data generated by de-quantizing received spectral data to the loss compensation part 420, or transfer the de-quantized spectral data to scaling part 430 by bypassing the loss compensation part 420 when noise filling is skipped.

The loss compensation part 420 is the same element of the former compensation part 220 described with reference to FIG. 9. If noise filling is applied to a current frame, the loss compensation part 420 performs the noise filling on the current frame using the noise level and the noise offset.

The scaling part 430 is the same element of the filmier scaling part 230 described with reference to FIG. 9 and obtains a spectral coefficient by scaling a de-quantized or compensated spectral data.

If an audio signal (e.g., a spectral coefficient) has a large audio characteristic, the audio signal decoder 440 decodes the audio signal according to an audio coding scheme. In this case, the audio coding scheme may follow the AAC (advanced audio coding) standard or HE-AAC (high efficiency advanced audio coding) standard, by which the present invention is non-limited. If the audio signal has a large speech characteristic, the speech signal decoder 450 decodes the downmix signal according to a speech coding scheme. In this case, the speech coding scheme may follow the AMR-WB (adaptive multi-rate wideband) standard, by which the present invention is non-limited.

The band extension decoding unit 460 reconstructs a signal of a high frequency band based on the band extension information by performing a band extension decoding scheme on the output signals from the audio and speech signal decoders 440 and 450.

And, the plural channel decoder 470 generates an output channel signal of a multi-channel signal (stereo signal included) using spatial information if the decoded audio signal is a downmix.

The audio signal processing apparatus according to the present invention is available for various products to use. Theses products can be mainly grouped into a stand alone group and a portable group. A TV, a monitor, a settop box and the like can be included in the stand alone group. And, a PMP, a mobile phone, a navigation system and the like can be included in the portable group.

Figure 14:
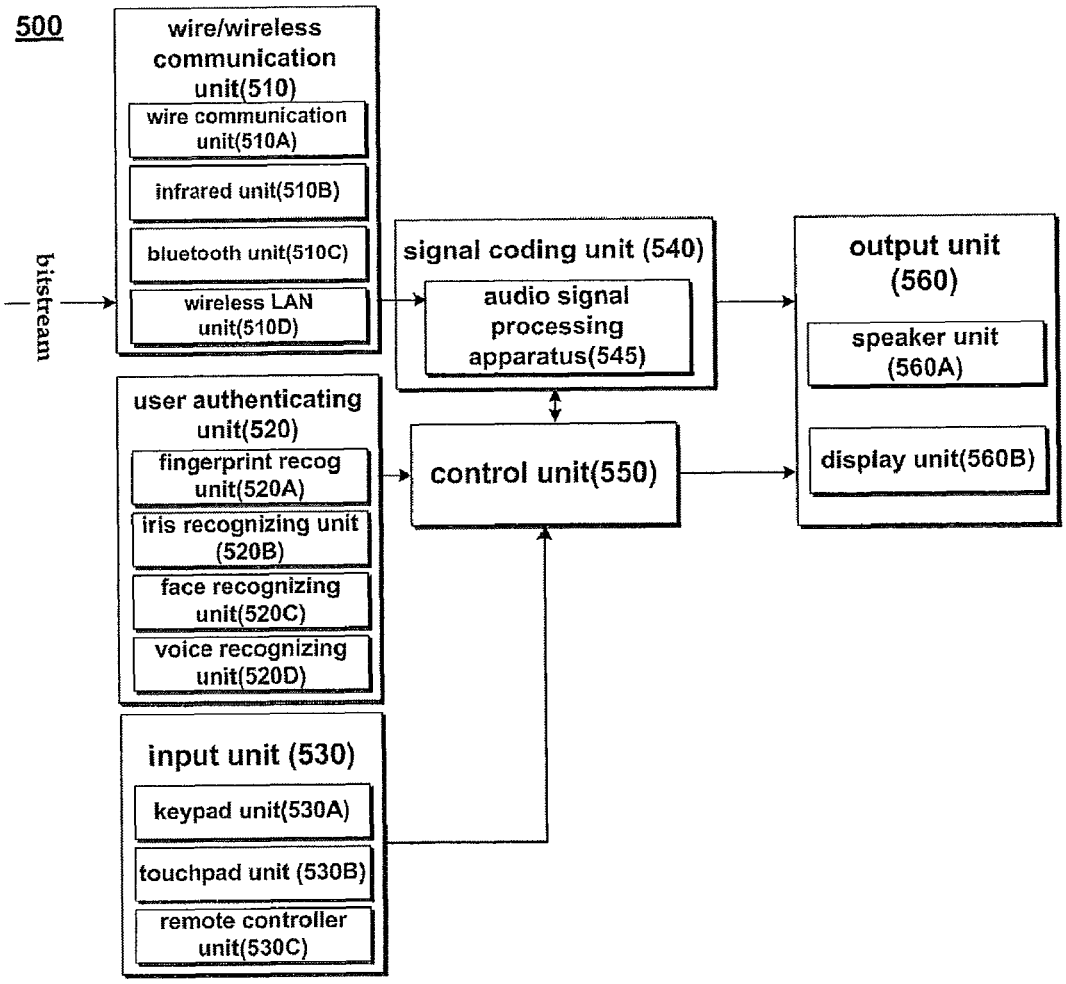
FIG. 14 is a schematic diagram of a product in which an audio signal processing apparatus according to one embodiment of the present invention is implemented.

FIG. 14 shows relations between products, in which an audio signal processing apparatus according to an embodiment of the present invention is implemented.

Referring to FIG. 14, a wire/wireless communication unit 510 receives a bitstream via wire/wireless communication system. In particular, the wire/wireless communication unit 510 can include at least one of a wire communication unit 510A, an infrared unit 510B, a Bluetooth unit 510C and a wireless LAN unit 510D.

A user authenticating unit 520 receives an input of user information and then performs user authentication. The user authenticating unit 520 can include at least one of a fingerprint recognizing unit 520A, an iris recognizing unit 520B, a face recognizing unit 520C and a voice recognizing unit 520D. The fingerprint recognizing unit 520A, the iris recognizing unit 520B, the face recognizing unit 520C and the speech recognizing unit 520D receive fingerprint information, iris information, face contour information and voice information and then convert them into user informations, respectively. Whether each of the user informations matches pre-registered user data is determined to perform the user authentication.

An input unit 530 is an input device enabling a user to input various kinds of commands and can include at least one of a keypad unit 530A, a touchpad unit 530B and a remote controller unit 530C, by which the present invention is non-limited.

A signal coding unit 540 performs encoding or decoding on an audio signal and/or a video signal, which is received via the wire/wireless communication unit 510, and then outputs an audio signal in time domain. The signal coding unit 540 includes an audio signal processing apparatus 545. As mentioned in the foregoing description, the audio signal processing apparatus 545 corresponds to the above-described embodiment (i.e., the encoder side 100 and/or the decoder side 200) of the present invention. Thus, the audio signal processing apparatus 545 and the signal coding unit including the same can be implemented by at least one or more processors.

A control unit 550 receives input signals from input devices and controls all processes of the signal decoding unit 540 and an output unit 560. In particular, the output unit 560 is an element configured to output an output signal generated by the signal decoding unit 540 and the like and can include a speaker unit 560A and a display unit 560B. If the output signal is an audio signal, it is outputted to a speaker. If the output signal is a video signal, it is outputted via a display.

Figure 15:
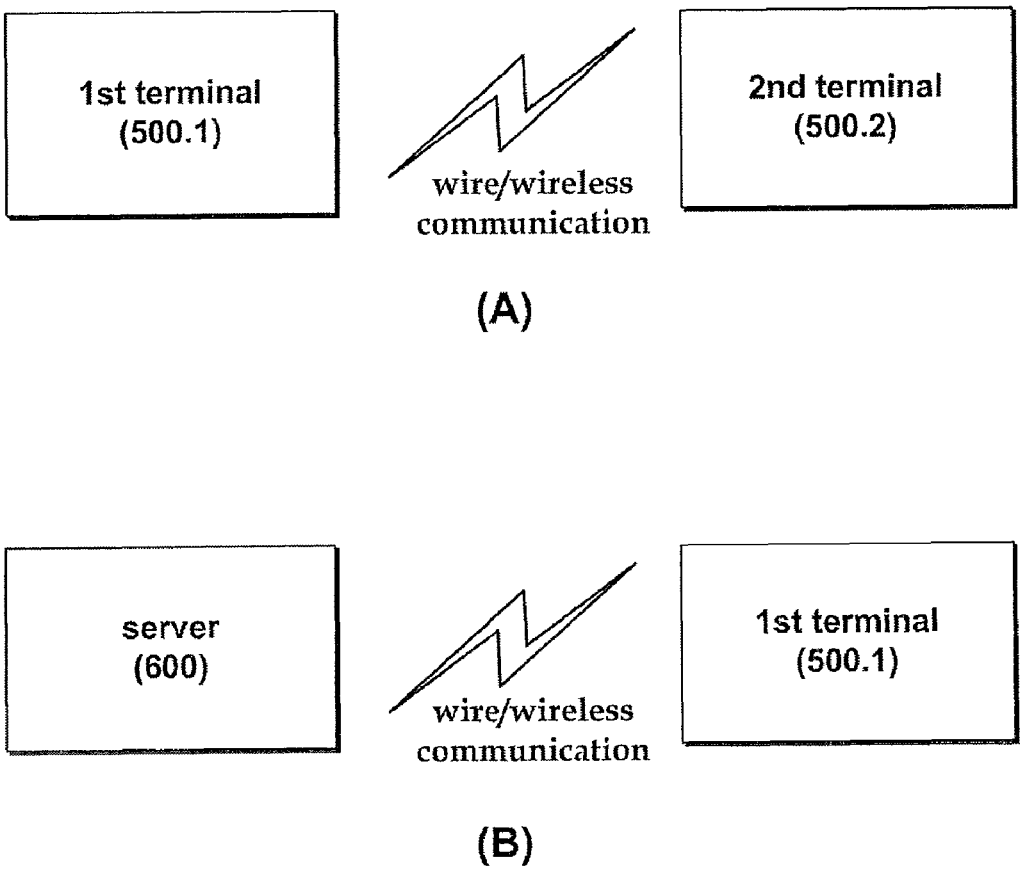
FIG. 15 is a diagram for relations of products provided with an audio signal processing apparatus according to one embodiment of the present invention.

FIG. 15 is a diagram for relations of products provided with an audio signal processing apparatus according to an embodiment of the present invention. FIG. 15 shows the relation between a terminal and server corresponding to the products shown in FIG. 14.

Referring to (A) of FIG. 15, it can be observed that a first terminal 500.1 and a second terminal 500.2 can exchange data or bitstreams bi-directionally with each other via the wire/wireless communication units. Referring to (B) of FIG. 15, it can be observed that a server 600 and a first terminal 500.1 can perform wire/wireless communication with each other.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). And, a bitstream generated by the above mentioned encoding method can be stored in the computer-readable recording medium or can be transmitted via wire/wireless communication network.

Accordingly, the present invention provides the following effects and/or advantages.

First of all, the present invention is able to omit a transmission of information on noise filling for a frame to which a noise filling scheme is not applied, thereby considerably reducing the number of bits of a bitstream.

Secondly, since specific information on noise filling is extracted from a bitstream by determining whether noise filling is applied to a current frame, the present invention is able to efficiently obtain necessary information without barely increasing complexity for a parsing process.

Thirdly, the present invention does not transmit an intact value for information having an almost same value for each frame but transmits a difference value differing from a corresponding value of a previous frame, thereby further reducing the number of bits.

Accordingly, the present invention is applicable to processing and outputting an audio signal.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method for processing an audio signal, the method comprising:

extracting, by an audio processing apparatus, spectral data and noise filling flag information indicating whether noise filling is used for a plurality of frames, the spectral data being inverse-quantized;

extracting coding scheme information indicating whether a current frame included in the plurality of frames is coded in either a frequency domain or a time domain;

when the noise filling flag information indicates that the noise filling is used for the plurality of frames and the coding scheme information indicates that the current frame is coded in the frequency domain, extracting noise level information for the current frame, and noise offset information for modifying a scale factor for the current frame, wherein the noise offset information is provided for a spectral band having a loss area corresponding to spectral data of zero; and performing the noise-filling for the current frame based on a noise level value and the noise offset information, the noise level value corresponding to the noise level information which comprises:

determining the loss area of the current frame based on the spectral data of the current frame;

generating a compensated spectral data of the current frame by filling the loss area with a random signal using the noise level value corresponding to the noise level information; and generating a compensated scale factor by modifying the scale factor of the current frame based on the noise offset information, wherein the compensated scale factor is applied to the spectral band corresponding to at least one spectral data.

2. The method of claim 1, further comprising:

extracting a level pilot value representing a reference value of a noise level, and an offset pilot value representing a reference value of a noise offset;

obtaining the noise level value by summing the level pilot value and the noise level information; and when the noise offset information is extracted, obtaining a noise offset value by summing the offset pilot value and the noise offset information, wherein the noise filling is performed using the noise level value and the noise offset value.

3. The method of claim 1, further comprising:

obtaining the noise level value of the current frame using a noise level value of a previous frame and the noise level information of the current frame; and when the noise offset information is extracted, obtaining a noise offset value of the current frame using a noise offset value of the previous frame and the noise offset information of the current frame, wherein the noise filling is performed using the noise level value and the noise offset value.

4. The method of claim 1, wherein both the noise level information and the noise offset information are extracted according to variable length coding scheme.

5. The method of claim 1, wherein the noise offset information is extracted when the noise level value meets a predetermined level.

6. An apparatus for processing an audio signal, the apparatus comprising:

a demultiplexer extracting, spectral data and noise filling flag information indicating whether noise filling is used for a plurality of frames, and coding scheme information indicating whether a current frame included in the plurality of frames is coded in either a frequency domain or a time domain, the spectral data being inverse-quantized;

a noise information decoding part using a processor, when the noise filling flag information indicates that the noise filling is used for the plurality of frames and the coding scheme information indicates that the current frame is coded in the frequency domain, extracting noise level information for the current frame, and noise offset information for modifying a scale factor for the current frame, wherein the noise offset information is provided for a spectral band having a loss area corresponding to spectral data of zero; and a loss compensation part determining the loss area of the current frame based on the spectral data of the current frame, generating a compensated spectral data of the current frame by filling the loss area with a random signal using a noise level value corresponding to the noise level information, and generating a compensated scale factor by modifying the scale factor of the current frame based on the noise offset information, wherein the scale factor is applied to the spectral band corresponding to at least one spectral data.

7. The apparatus of claim 6, further comprising:

a data decoding part configured to:

extract a level pilot value representing a reference value of a noise level, and an offset pilot value representing a reference value of a noise offset, obtain the noise level value by summing the level pilot value and the noise level information, and when the noise offset information is extracted, obtain a noise offset value by summing the offset pilot value and the noise offset information, wherein the noise filling is performed using the noise level value and the noise offset value.

8. The apparatus of claim 6, further comprising:

a data decoding part configured to:

obtain the noise level value of the current frame using a noise level value of a previous frame and the noise level information of the current frame, and when the noise offset information is extracted, obtain a noise offset value of the current frame using a noise offset value of the previous frame and the noise offset information of the current frame, wherein the noise filling is performed using the noise level value and the noise offset value.

9. The apparatus of claim 6, wherein both the noise level information and the noise offset information are extracted according to variable length coding scheme.

10. A method for processing an audio signal, the method comprising:

receiving, by an audio processing apparatus, a spectral data and a scale factor as a quantized signal, wherein the scale factor is applied to a spectral band corresponding to at least one spectral data;

generating a noise level value and a noise offset value based on the quantized signal;

generating noise filling flag information indicating whether noise filling is used to a plurality of frames;

generating coding scheme information indicating whether a current frame included in the plurality of frames is coded in either a frequency domain or a time domain;

when the noise filling flag information indicates that the noise filling is used to for the plurality of frames and the coding scheme information indicates that the current frame is coded in the frequency domain, inserting noise level information for the current frame corresponding to the noise level value and noise offset information corresponding to the noise offset value into a bitstream, wherein the noise offset information is used for modifying the scale factor for the current frame, and the noise offset information is provided for a spectral band having a loss area corresponding to spectral data of zero.

11. The method of claim 10, wherein the noise offset information is inserted into the bitstream when the noise level value meets a predetermined level.

12. An apparatus for processing an audio signal, the apparatus comprising:

a loss compensation estimating part using a processor receiving a spectral data and a scale factor as a quantized signal, wherein the scale factor is applied to a spectral band corresponding to at least one spectral data, and generating a noise level value and a noise offset value based on the quantized signal, and noise filling flag information indicating whether noise filling is used for a plurality of frames;

a signal classifier generating coding scheme information indicating whether a current frame included in the plurality of frames is coded in either a frequency domain or a time domain; and a noise information encoding part, when the noise filling flag information indicates that the noise filling is used for the plurality of frames and the coding scheme information indicates that the current domain is coded in the frequency domain, inserting noise level information for the current frame corresponding to the noise level value and noise offset information corresponding to the noise offset value into a bitstream, wherein the noise offset information is used for modifying the scale factor for the current frame, and wherein the noise offset information is provided for a spectral band having a loss area corresponding to spectral data of zero.

13. A non-transitory computer-readable medium having instructions stored thereon, which, when executed by a processor, causes the processor to perform operations, comprising:

extracting, by an audio processing apparatus, spectral data and noise filling flag information indicating whether noise filling is used for a plurality of frames, the spectral data being inverse-quantized;

extracting coding scheme information indicating whether a current frame included in the plurality of frames is coded in either a frequency domain or a time domain;

when the noise filling flag information indicates that the noise filling is used for the plurality of frames and the coding scheme information indicates that the current frame is coded in the frequency domain, extracting noise level information for the current frame and noise offset information for modifying a scale factor for the current frame, wherein the noise offset information is provided for a spectral band having a loss area corresponding to spectral data of zero; and performing the noise-filling for the current frame based on a noise level value and the noise offset information, the noise level value corresponding to the noise level information which comprises:

determining the loss area of the current frame based on the spectral data of the current frame;

generating a compensated spectral data of the current frame by filling the loss area with a random signal using the noise level value corresponding to the noise level information; and generating a compensated scale factor by modifying the scale factor of the current frame based on the noise offset information, wherein the scale factor is applied to the spectral band corresponding to at least one spectral data.

* * * * *